US006336704B1

(12) United States Patent
Shimada

(10) Patent No.: US 6,336,704 B1
(45) Date of Patent: Jan. 8, 2002

(54) PRINTER, PRINTING METHOD, INK CARTRIDGE USED FOR PRINTER, AND PROGRAM PRODUCT UTILIZED BY PRINTER

(75) Inventor: Kazumichi Shimada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/382,633

(22) Filed: Aug. 25, 1999

(30) Foreign Application Priority Data

Aug. 28, 1998 (JP) ..... 10-259477

(51) Int. Cl.[7] ..... B41J 2/21; B41J 2/175
(52) U.S. Cl. ..... 347/43; 347/86
(58) Field of Search ..... 347/43, 105, 100, 347/86

(56) References Cited

U.S. PATENT DOCUMENTS 4,543,590 A * 9/1985 Tazaki et al. ..... 347/15
5,371,531 A * 12/1994 Rezanka et al. ..... 347/43
5,428,377 A * 6/1995 Stoffel et al. ..... 347/15
5,742,306 A * 4/1998 Gompertz et al. ..... 347/43
5,988,791 A * 11/1999 Miyashita et al. ..... 347/43
6,053,609 A * 4/2000 Barton et al. ..... 347/105

* cited by examiner

*Primary Examiner*—Thinh Nguyen
(74) *Attorney, Agent, or Firm*—Oblon, Spivak, McClelland, Maier & Neustadt, P.C.

(57) ABSTRACT

The technique of the present invention utilizes two different inks that are mixed with each other to express an achromatic color, in order to reduce the degree of granularity while decreasing the total quantity of inks. The black ink used in the present invention to create dots of black color is mixing black ink (Bk) that contains magenta and yellow dyes as well as a black dye, such as Food black, and thereby has a less quantity of the black dye. In order to express black color, dots of the mixing black ink (Bk) are mixed with dots of cyan ink (C), which compensates for a certain hue that is insufficient in a black color expressed by the mixing black ink (Bk). The mixing black ink (Bk) has higher lightness than a conventional real black ink and thereby reduces the degree of granularity in a resulting printed image. This arrangement of the invention enables creation of dots with the mixing black ink (Bk) to start from a lower density area, thereby reducing a total quantity of the respective color inks used for printing, which has a sufficient margin to a predetermined ink duty of paper.

17 Claims, 12 Drawing Sheets

*Fig.8*

Compositions of Inks

| | | C | M | Y | Bk |
|---|---|---|---|---|---|
| Dyes | DirectBlue199 | 3.6 | | | |
| | AcidRed289 | | 2.8 | | 1.4 |
| | DirectYellow86 | | | 1.8 | 0.9 |
| | FoodBlack2 | | | | 2.4 |
| Diethylene glycol | | 30 | 20 | 30 | 25 |
| Surfinol 465 | | 1 | 1 | 1 | 1 |
| Water | | 65.4 | 76.2 | 67.2 | 69.3 |
| Viscosity (mPa·s) | | 3.0 | 3.0 | 3.0 | 3.0 |

*Fig.9*

PRIOR ART

Compositions of Inks

| | | C | M | Y | Bk |
|---|---|---|---|---|---|
| Dyes | DirectBlue199 | 3.6 | | | |
| | AcidRed289 | | 2.8 | | |
| | DirectYellow86 | | | 1.8 | |
| | FoodBlack2 | | | | 4.8 |
| Diethylene glycol | | 30 | 20 | 30 | 25 |
| Surfinol 465 | | 1 | 1 | 1 | 1 |
| Water | | 65.4 | 76.2 | 67.2 | 69.2 |
| Viscosity (mPa·s) | | 3.0 | 3.0 | 3.0 | 3.0 |

PRINTER, PRINTING METHOD, INK CARTRIDGE USED FOR PRINTER, AND PROGRAM PRODUCT UTILIZED BY PRINTER

BACKGROUND OF THE INVENTION

1. Field of the Invention

The present invention relates to a printer with a head that is recordable a plurality of different inks on a printing medium, as well as to a corresponding method of printing, an ink cartridge used for such a printer, and a program product utilized by such a printer.

2. Description of the Related Art

Color printers with a head that records a plurality of different color inks on a printing medium are widely used as an output device of a computer, which prints an image processed by the computer in a multi-color, multi-tone manner. There are a variety of known methods to record ink on the printing medium: a thermal transfer mechanism that fuses ink on an ink ribbon and transfers the fused ink to printing paper; an ink jet mechanism that ejects color ink drops onto printing paper; and an electrophotographic mechanism that generates a latent image on a photosensitive material by means of laser and transfers one or plural color toners corresponding to the generated latent image. In any of such mechanisms, a plurality of different color inks are mixed to reproduce colors in a predetermined range of hues. Three primary color inks, cyan (C), magenta (M), and yellow (Y) are typically used for full-color printing. A black ink is provided in addition to these three primary color inks CMY, in order to ensure high-speed printing of letters (generally in black) and reduce the total quantity of inks used for printing by the under color removal.

A variety of techniques, such as the dither method and the error diffusion method may be applied to print a multi-color, multi-tone image with a plurality of different inks. In any of these applicable techniques, the printer carries out printing with dots of a specific size corresponding to a preset printing resolution. The printers generally have the printing density or printing resolution in the range of 300 dpi to 720 dpi and the particle diameter of several tens microns. Even the newly developed high-resolution printers have the printing resolution of about 1440 dpi. This is, however, significantly lower than the expression power of silver films (generally having the resolution of several thousands dpi). The printer accordingly has the problem that dots are visually observable to cause granularity in a resulting printed image. Some techniques have been proposed, in order to solve this problem. The proposed technique provides inks of different densities or applies the mechanism of varying the dot diameter to carry out printing with low-density dots or with small-diametral dots.

In the configuration of printing an image by dots, dots created by a black ink having the highest density causes the highest degree of granularity. The conventionally known technique accordingly does not use the real black ink but expresses a black color (generally referred to as the composite black) with three primary color inks in the case of high-quality printing of an image.

The known composite black technique that expresses the black color with three primary color inks, however, requires dots of all the three primary colors to express a single black dot. This triples the required number of dots. The following problems arise due to an increase in number of dots required for expressing an achromatic color of a specific density:

(1) In an ink jet printer that provides an ink prepared by dissolving a pigment or a dye in a solvent and causes the ink to be ejected as ink droplets on printing paper, the total quantity of inks ejected per unit area is restricted by the ink duty of the printing paper, that is, the quantity of ink that can be absorbed by the printing paper. The total quantity of inks to express the black color by the composite black may exceed the restriction of the ink duty in the event that the printing paper used has a relatively low ink duty.

(2) The composite black technique expresses the black color with three primary color inks. There is accordingly insufficiency of the required density as the black color and may give certain unclearness to the whole image. In the event that the three primary colors have high dot densities, the overlap of the respective color dots created in a certain sequence may cause color mismatch. Especially in the case of non-liquid inks, such as thermally fusible inks, the overlap of the respective dots may give the impression of coating the different inks one after another. It is accordingly difficult to attain the dot density of or over a certain level as the black color.

(3) At the boundary where the dots of the composite black are gradually replaced by the dots of the real black ink, the state filled with the dots of the three different color inks to express the black color is changed to the state filled with the dots of only one black ink to express the black color. The blotting condition may change over the boundary when the printing paper is readily affected by the blot. In this case, the resulting printed image may not have a uniform picture quality.

A variety of techniques have thus been proposed to partly replace dots of the real black ink with dots of the composite black in an allowable range specified by the ink duty and the restriction of the dot density. In any of such known techniques, dots of the real black ink are created at or over a predetermined density. This undesirably worsens the granularity at the boundary that starts creation of dots by the real black ink.

SUMMARY OF THE INVENTION

The object of the present invention is thus to adjust hues of at least two different inks and satisfy a predetermined ink duty of a printing medium and other required conditions without lowering the picture quality of a resulting recorded image in a printer with a head that is capable of recording a plurality of different inks on the printing medium.

At least part of the above and the other related objects is attained by a printer with a head that is capable of recording a plurality of different inks on a printing medium. Two among the plurality of different inks are a specific chromatic color ink having a predetermined hue and a particular ink having a certain hue that is mixed with the specific chromatic color ink at a predetermined rate to express a black color. The printer includes a black color recording unit that causes the head to record the specific chromatic color ink and the particular ink at the predetermined rate on the printing medium, so as to express the black color.

The present invention is also directed to a method of printing, which corresponds to the above printer. The method causes a printer to print an image with a head that is capable of recording a plurality of different inks on a printing medium. The method includes the steps of: providing a specific chromatic color ink having a predetermined hue and a particular ink having a certain hue that is mixed with the specific chromatic color ink at a predetermined rate to express a black color, as two among the plurality of different inks; and causing the head to record the two inks at the predetermined rate on the printing medium, so as to express the black color.

The printer or the printing method corresponding thereto of the present invention provides the specific chromatic color ink having a predetermined hue and the particular ink having a certain hue that is mixed with the specific chromatic color ink at a predetermined rate to express a black color, as two among the plurality of different inks used for printing. The head is made to record the specific chromatic color ink and the particular ink at the predetermined rate on the printing medium, so as to express the black color. In order to record an achromatic multi-tone image, black dots are not created solely by real black ink but are created by the specific chromatic color ink and the particular ink that expresses the black color in combination with the specific chromatic color ink. Compared with the case in which black dots are created solely by the real black ink, this arrangement of the present invention enables printing with less granularity.

From the viewpoint of reducing the degree of granularity of dots, it is desirable that both the two inks cause less granularity. It is also preferable to use, as the specific chromatic color ink, a color ink causing low granularity when dots are recorded with the color ink on the printing medium, for example, yellow ink.

The technique of expressing the black color with the two inks is applicable to a printer for multi-color printing. In this case, the printer has an ink cartridge that accommodates therein, as the plurality of different inks, the specific chromatic color ink and the particular ink, as well as another color ink, which corresponds to one of three primary colors and is capable of expressing a predetermined color space in cooperation with the specific chromatic color ink having the predetermined hue. The printer also includes: an ink rate setting unit that sets a rate of quantities of the respective inks corresponding to a color to be expressed in the predetermined color space; and a head driving unit that drives the head to record the respective inks on the printing medium at the rate set by the ink rate setting unit, with regard to image data to be printed.

This printer enables multi-color printing with the three primary colors, and does not express the black color as composite black formed by three different inks. The printer uses one color ink corresponding to one of the three primary colors and another ink that is capable of expressing the black color in combination with the color ink, in order to express the black color. This arrangement does not require three different inks to express the black color, thereby satisfying the restriction by the ink duty of the printing medium and reducing the possibility of color mismatch due to overlap of different color dots. The black color expressed by this arrangement gives a clearer impression to the resulting image than the composite black.

In accordance with one preferable application of the printer having the configuration discussed above, the respective inks are liquid, and the head has a mechanism for causing each of the respective inks to be ejected in the form of ink droplets on the printing medium. A specific value that satisfies an ink duty of the printing medium is set to the rate of the quantities of the respective inks. In the case of liquid ink, it is extremely important to satisfy the ink duty set for each printing medium, that is, the upper limit of ink quantity absorbable by the printing medium. This arrangement of the printer enables the ink duty set for each printing medium to be readily satisfied and gives less granularity to the resulting printed image.

The technique of the present invention expresses the black color by mixture of two different inks. It may be preferable to use a specific ink cartridge to attain such printing. The present invention is thus directed to an ink cartridge attached to a printer with a head that is capable of recording a plurality of different inks on a printing medium. Two among the plurality of different inks are a specific chromatic color ink having a predetermined hue and a particular ink having a certain hue that is mixed with the specific chromatic color ink at a predetermined rate to express a black color. At least one of these two inks is accommodated in the ink cartridge.

This ink cartridge is applicable for the printer that expresses the black color by mixture of two different inks. These two inks are reserved in different ink chambers located in one identical ink cartridge. This arrangement enables at least two required inks to be supplied efficiently from one ink cartridge to the printer.

The specific chromatic color ink included in the ink cartridge may be any one of cyan ink, magenta ink, and yellow ink. Any of these inks can be supplied stably at relatively low cost.

It is also preferable that the ink cartridge accommodates another color ink that corresponds to one of three primary colors and is capable of expressing a predetermined color space in cooperation with the specific chromatic color ink having the predetermined hue, in addition to the two inks. In this case, the specific chromatic color ink is commonly included in both the two inks for expressing the black color and at least three color inks for expressing the predetermined color space. This ensures the desirable size reduction of the ink cartridge.

In accordance with one preferable application, a volume of the common specific chromatic color ink accommodated in the ink cartridge is preset to be greater than a volume of the another color ink by a predetermined factor. This arrangement effectively prevents the unbalance quantities of the inks from remaining in the ink cartridge.

The technique of the present invention may be attained by the computer and provided as a program product in which a program code is recorded in a recording medium. The present invention is thus to directed to a program product that includes a program code, which causes a printer to print an image with a head that is capable of recording a plurality of different inks on a printing medium, and a recording medium in which the program code is stored in a computer readable manner. The program code includes: a first program code that causes a computer to input a density of black color included in an image to be recorded; a table that stores recording rates of a specific chromatic color ink and a mixing black ink, which are included in the plurality of different inks, corresponding to a varying density of black color, the specific chromatic color ink having a predetermined hue, the mixing black ink having a certain hue that is mixed with the specific chromatic color ink at a predetermined rate to express a black color; and a second program code that causes the computer to refer to the table and determine the recording rates of the specific chromatic color ink and the mixing black ink corresponding to the input density of black color.

A computer incorporated in a printer, or alternatively a printer driver of a computer in the case where the computer is combined with a printer to constitute a printing system, reads the program product to attain the functions discussed below. The printer provides a specific chromatic color ink having a predetermined hue and a particular ink having a certain hue that is mixed with the specific chromatic color ink at a predetermined rate to express a black color, as two among the plurality of different inks used for printing. When reading the respective program codes included in the program product, the printer causes the head to record the specific chromatic color ink and the particular ink at the predetermined rate on the printing medium, so as to express the black color. In order to record an achromatic multi-tone image, black dots are not created solely by real black ink but are created by the specific chromatic color ink and the particular ink that expresses the black color in combination with the specific chromatic color ink. Compared with the case in which black dots are created solely by the real black ink, this arrangement of the present invention enables printing with less granularity.

The program product may also include other elements to attain the functions corresponding to the various applications of the printer discussed above. By way of example, the program code of the program product may further include: a third program code that causes the computer to identify an ink cartridge attached to the printer and determine which of an ink cartridge accommodating therein the mixing black ink and another ink cartridge accommodating therein a real black ink that is capable of expressing a black color independently; a fourth program code that causes the computer to select an appropriate table for the identified ink cartridge among a plurality of tables, which are provided for different ink cartridges and store recording rates of respective inks corresponding to a varying density of black color; and a fifth program code that causes the computer to refer to the selected table and determine the recording rates of the respective inks.

The printer reading these program codes identifies the ink cartridge attached to the printer and refers to the appropriate table corresponding to the identified ink cartridge for printing.

In accordance with another embodiment, the program code of the program product may further include: a sixth program code that causes the computer to identify an image to be recorded; a seventh program code that causes the computer to record an image with an ink cartridge accommodating therein the mixing black ink in the case where the identified image is a natural picture; and an eighth program code that causes the computer to record an image with another ink cartridge accommodating therein a real black ink that is capable of expressing a black color independently, in the case where the identified image is not a natural picture.

Another application of the present invention is a product that includes data, which are referred to by a program for controlling a printer that prints an image with a head that is capable of recording a plurality of different inks on a printing medium, and a recording medium, in which the data are recorded in a computer readable manner. The data include a table that stores recording rates of a specific chromatic color ink and a mixing black ink, which are included in the plurality of different inks, corresponding to a varying density of black color included in an image to be recorded. The specific chromatic color ink has a predetermined hue, and the mixing black ink has a certain hue that is mixed with the specific chromatic color ink at a predetermined rate to express a black color.

The computer incorporated in the printer reads the program codes or data discussed above to actualize the specific functions of the printer. The characteristics of the program codes or data may be known without causing the printer to perform the related operations but by analyzing the program codes or data recorded in the recording. The program codes or data are generally recorded in a recording medium, such as a CD-ROM or a flexible disk, but may alternatively be stored in a storage medium, such as a hard disk in the computer, or transmitted in the form of a protocol or a carrier wave through a computer network. A plurality of program codes constituting one program product may be recorded separately in different recording media. In accordance with another possible application, a program code relating to the basic operations of a printer is incorporated in advance in the printer, whereas a program code corresponding to the principle of the present invention may be distributed separately. These configurations also correspond to the program product of the present invention. By way of example, when the ink cartridge attached to the printer accommodates at least one of the specific chromatic color ink having a predetermined hue and the particular ink having a certain hue that is mixed with the specific chromatic color ink at a predetermined rate to express a black color, a specific program code that actualizes the printing method discussed above by taking advantage of the properties of the inks accommodated in the ink cartridge may be attached to the ink cartridge, for example, in the form of a flexible disk. The specific program code may alternatively be transmitted from a web page through a computer network such as the Internet.

These and other objects, features, aspects, and advantages of the present invention will become more apparent from the following detailed description of the preferred embodiment with the accompanying drawings.

BRIEF DESCRIPTION OF THE DRAWINGS

FIG. 8 is a table showing the compositions of the respective color inks used in this embodiment;

FIG. 9 is a table showing the compositions of the respective color inks used in a conventional printer;

DESCRIPTION OF THE PREFERRED EMBODIMENTS

Figure 1:
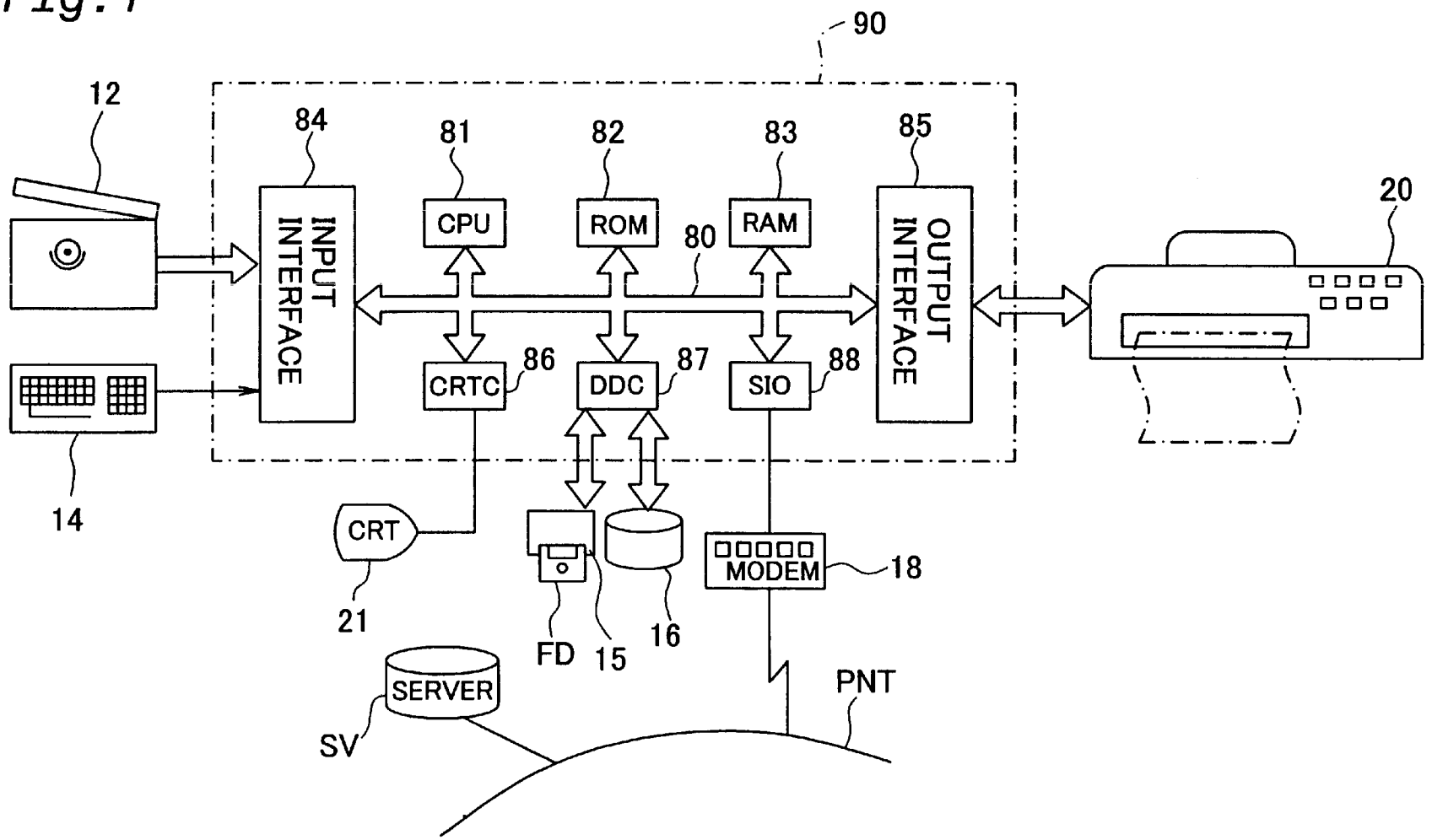
FIG. 1 is a block diagram schematically illustrating the structure of a printing system including a printer 20 embodying the present invention.

FIG. 1 is a block diagram schematically illustrating the structure of a printing system including a printer embodying the present invention. The printing system includes a computer 90 connected to a scanner 12 and a color printer 20. The computer 90 reads and executes predetermined programs to ascertain the function of the printing system as a whole. As illustrated in FIG. 1, the computer 90 includes a CPU 81, which executes a variety of operations for controlling processes relating to image processing according to the programs, and the following constituents mutually connected via a bus 80. A ROM 82 stores in advance a variety of programs and data required for the execution of the various operations by the CPU 81. A variety of programs and data required for the execution of the various operations by the CPU 81 are temporarily written in and read from a RAM 83.

An input interface 84 receives signals from the scanner 12 and a keyboard 14, whereas an output interface 85 transmits data to the printer 20. A CRTC 86 controls output of signals to a color CRT display 21. A disk controller (DDC) 87 controls transmission of data to and from a hard disk 16, a flexible disk drive 15, and a CD-ROM drive (not shown). A variety of programs loaded to the RAM 83 and executed as well as a variety of other programs provided in the form of a device driver are stored in the hard disk 16. A serial input-output interface (SIO) 88 is also connected to the bus 80. The SIO 88 is connected to a modem 18 and further to a public telephone network PNT via the modem 18. The computer 90 is connected with an external network via the SIO 88 and the modem 18 and may gain access to a specific server SV to download the programs required for the image processing into the hard disk 16. Another possible application reads the required programs from a flexible disk FD or a CD-ROM and causes the computer 90 to execute the input programs.

Figure 2:
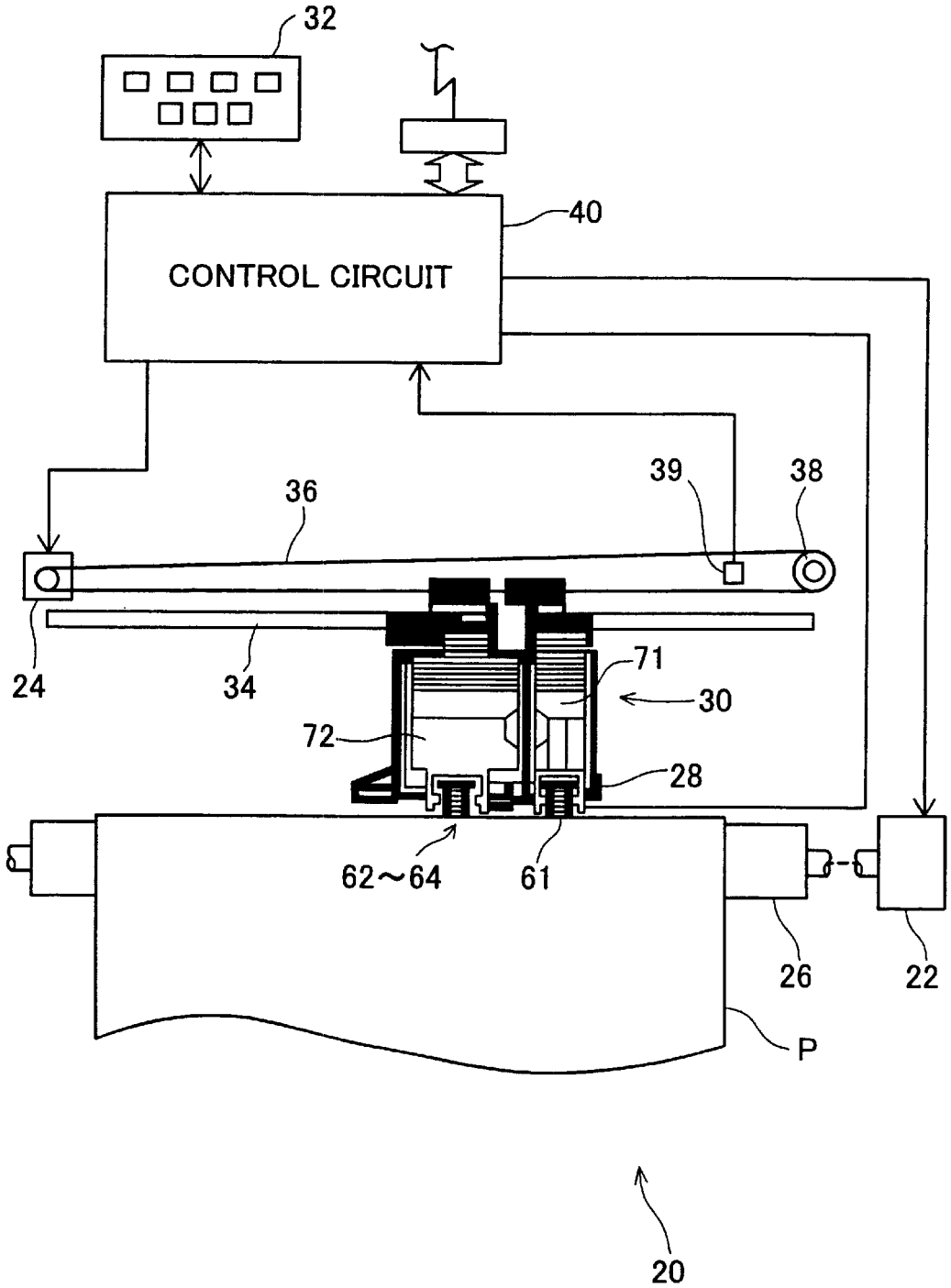
FIG. 2 schematically illustrates the structure of the printer 20 in the embodiment.

The schematic structure of the printer 20 used in this embodiment is described with the drawing of FIG. 2. The printer 20 has a mechanism for causing a sheet feed motor 22 to feed a sheet of printing paper P, a mechanism for causing a carriage motor 24 to move a carriage 30 forward and backward along an axis of a platen 26, a mechanism for driving a print head 28 mounted on the carriage 30 to control the ejection of ink and creation of dots, and a control circuit 40 that controls transmission of signals to and from the sheet feed motor 22, the carriage motor 24, the print head 28, and a control panel 32.

The mechanism for feeding the sheet of paper P has a gear train (not shown) that transmits rotations of the sheet feed motor 22 to the platen 26 as well as to a sheet feed roller (not shown). The mechanism for reciprocating the carriage 30 includes a sliding shaft 34 arranged in parallel with the axis of the platen 26 for slidably supporting the carriage 30, a pulley 38, an endless drive belt 36 spanned between the carriage motor 24 and the pulley 38, and a position sensor 39 that detects the position of the origin of the carriage 30.

Figure 3:
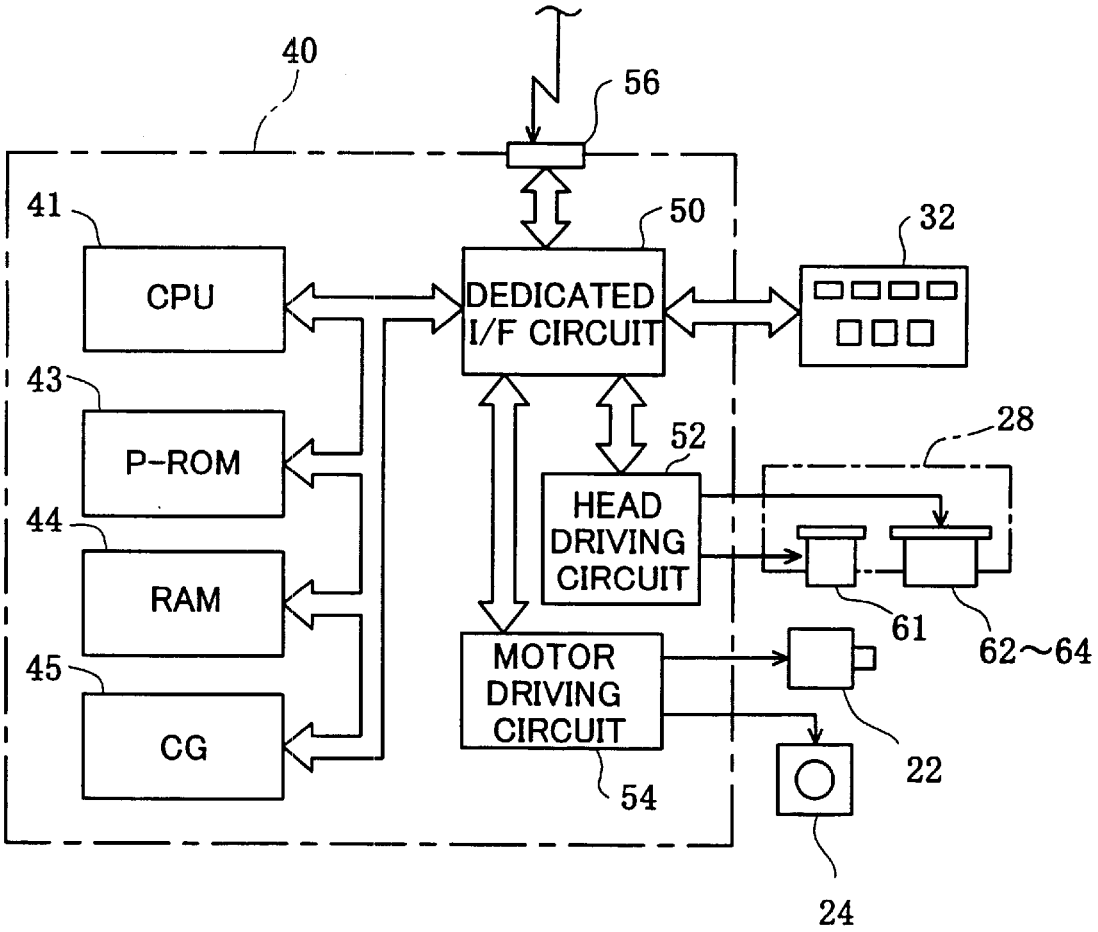
FIG. 3 is a block diagram showing the structure of a control circuit 40 included in the printer 20.

FIG. 3 illustrates the structure of the printer 20 including the control circuit 40. The control circuit 40 is constructed as an arithmetic and logic circuit including a well-known CPU 41, a P-ROM 43 in which programs are recorded, a RAM 44, and a character generator (CG) 45 that stores dot matrices of letters and symbols. The control circuit 40 also includes a dedicated I/F circuit 50 specifically working as an interface with an external motor and the like, a head driving circuit 52 that is linked with the dedicated I/F circuit 50 to drive the print head 28, and a motor driving circuit 54 that is also linked with the dedicated I/F circuit 50 to drive the sheet feed motor 22 and the carriage motor 24. The dedicated I/F circuit 50 includes a parallel interface circuit to be connectable with the computer via a connector 56 and to receive printing signals output from the computer.

A black ink cartridge 71 for black ink and a color ink cartridge 72 in which three color inks, that is, cyan, magenta, and yellow, are accommodated may be mounted on the carriage 30 of the printer 20. A total of four ink ejection heads 61 through 64 are formed on the print head 28 that is disposed in the lower portion of the carriage 30, and ink supply conduits 76 (see FIG. 4) are arranged upright in the bottom portion of the carriage 30 for leading supplies of inks from ink tanks to the respective ink ejection heads 61 through 64. When the black ink cartridge 71 and the color ink cartridge 72 are attached downward to the carriage 30, the ink supply conduits 76 are inserted into connection apertures (not shown) formed in the respective ink cartridges 71 and 72. This enables supplies of inks to be fed from the respective ink cartridges 71 and 72 to the ink ejection heads 61 through 64. Although the black ink cartridge 71 and the color ink cartridge 72 are separately attached to the carriage 30 in this embodiment, all the four color inks, black, cyan, magenta, and yellow, may alternatively be accommodated in one ink cartridge, which is attached to the carriage 30.

Figure 4:
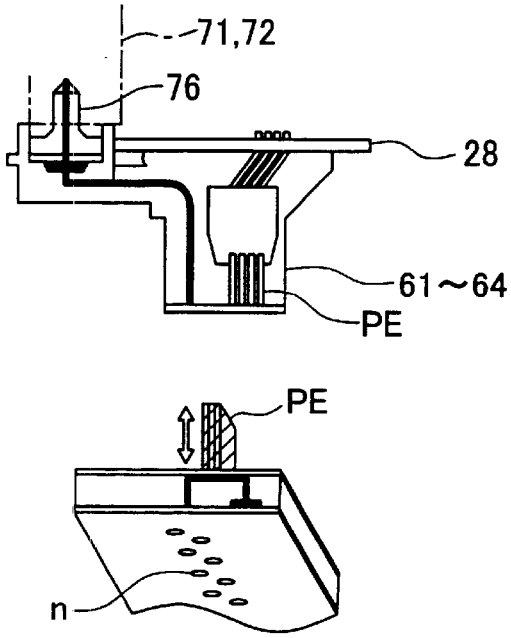
FIG. 4 shows a mechanism for ejecting ink from ink ejection heads 61 through 64.

The following briefly describes the mechanism of ejecting ink and creating dots. FIG. 4 schematically illustrates the internal structure of the print head 28. When the ink cartridges 71 and 72 are attached to the carriage 30, supplies of inks in the ink cartridges 71 and 72 are sucked out by capillarity through the ink supply conduits 76 and are led to the ink ejection heads 61 through 64 formed in the print head 28 arranged in the lower portion of the carriage 30 as shown in FIG. 4. In the event that the ink cartridges 71 and 72 are attached to the carriage 30 for the first time, a pump works to suck first supplies of inks into the respective ink ejection heads 61 through 64. In this embodiment, the structure of the pump for suction and a cap for covering the print head 28 during the suction is not illustrated nor described specifically.

Figure 5:
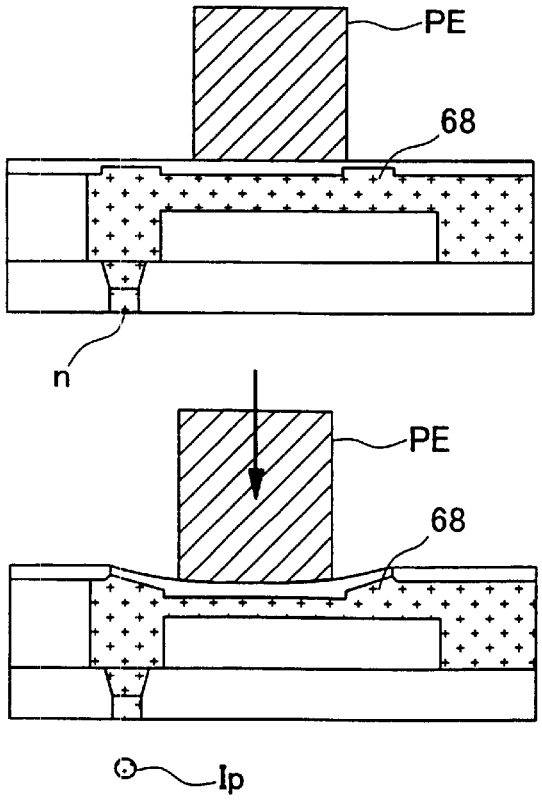
FIG. 5 shows a process of ejecting an ink particle Ip by the extension of a piezoelectric element PE.

An array of thirty-two nozzles n is formed in each of the ink ejection heads 61 through 64 as shown in FIG. 4. A piezoelectric element PE, which is one of electrically distorting elements and has an excellent response, is arranged for each nozzle n. FIG. 5 illustrates a configuration of the piezoelectric element PE and the nozzle n. As shown in the upper drawing of FIG. 5, the piezoelectric element PE is disposed at a position that comes into contact with an ink conduit 68 for leading ink to the nozzle n. As is known by those skilled in the art, the piezoelectric element PE has a crystal structure that is subjected to mechanical stress due to application of a voltage and thereby carries out extremely high-speed conversion of electrical energy into mechanical energy. In this embodiment, application of a voltage between electrodes on both ends of the piezoelectric element PE for a predetermined time period causes the piezoelectric element PE to extend for the predetermined time period and deform one side wall of the ink conduit 68 as shown in the lower drawing of FIG. 5. The volume of the ink conduit 68 is reduced with an extension of the piezoelectric element PE, and a certain amount of ink corresponding to the reduced volume is sprayed as an ink particle Ip from the end of the nozzle n at a high speed. The ink particles Ip soak into the sheet of paper P set on the platen 26, so as to implement printing.

In the printer 20 of the embodiment having the hardware structure discussed above, while the sheet feed motor 22 rotates the platen 26 and other rollers to feed the sheet of paper P, the carriage motor 24 drives and reciprocates the carriage 30, simultaneously with actuation of the piezoelectric elements PE on the respective ink ejection heads 61 through 64 of the print head 28. The printer 20 accordingly sprays the respective color inks provided in the ink cartridges 71 and 72 to form a multi-color image on the sheet of paper P.

The hue of the ink accommodated in the black ink cartridge 71 is referred to as black in the above discussion as a matter of convenience. In fact, the ink accommodated in the black ink cartridge 71 is not achromatic real black. As described later in detail, the black ink used in this embodiment contains not only a black dye (Food Black 2) but a magenta dye and a yellow dye as different hues, which is one of the prominent characteristics of this present invention. In the discussion herein, the black ink specifically used in this embodiment is referred to as the 'mixing black ink'. Namely in the description hereafter, the term 'mixing black ink' refers to a black ink containing other chromatic dyes as well as the black dye. For the purpose of discrimination, the conventional ink only containing the black dye is referred to as the 'real black ink'. In this embodiment, the quantities of the respective color inks are not identical. The following first describes the detailed structures of the ink cartridges 71 and 72 and the compositions of the respective color inks accommodated in the ink cartridges 71 and 72.

Figure 6:
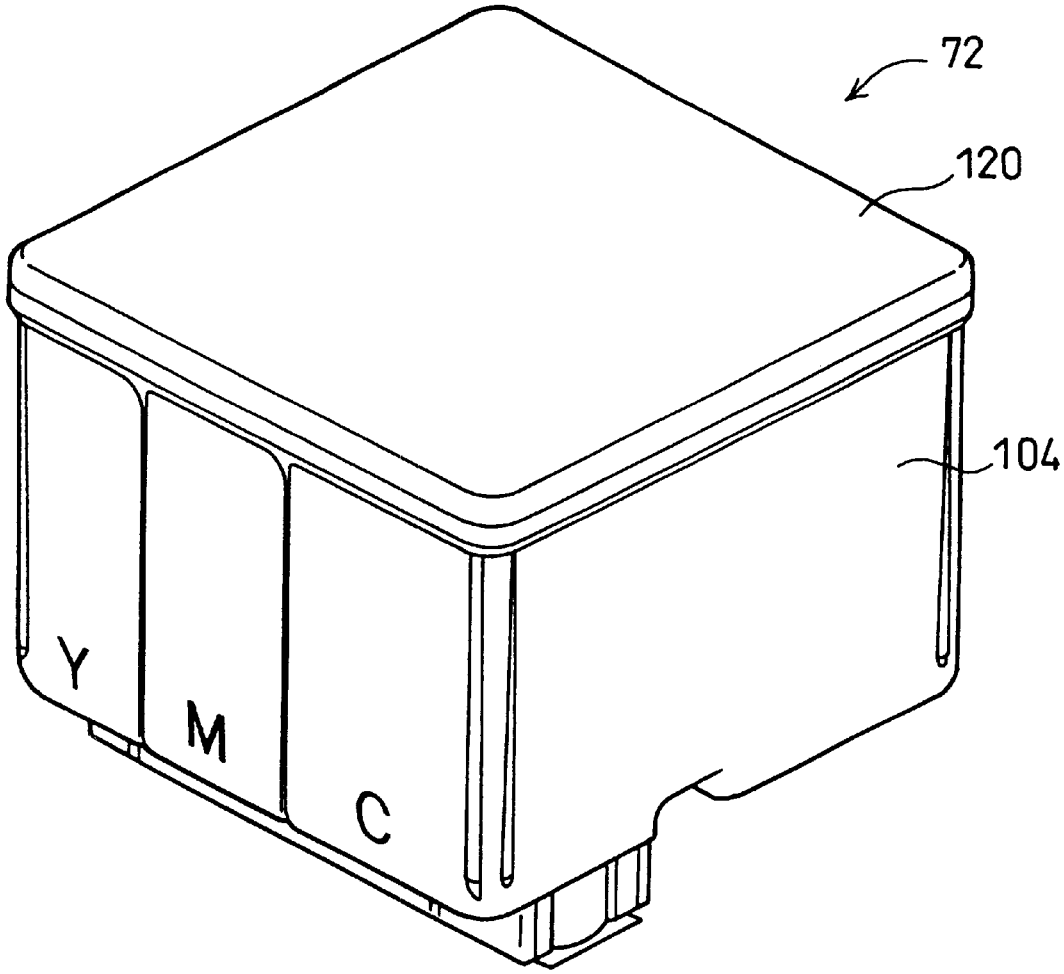
FIG. 6 shows the appearance of a color ink cartridge 72.
Figure 7:
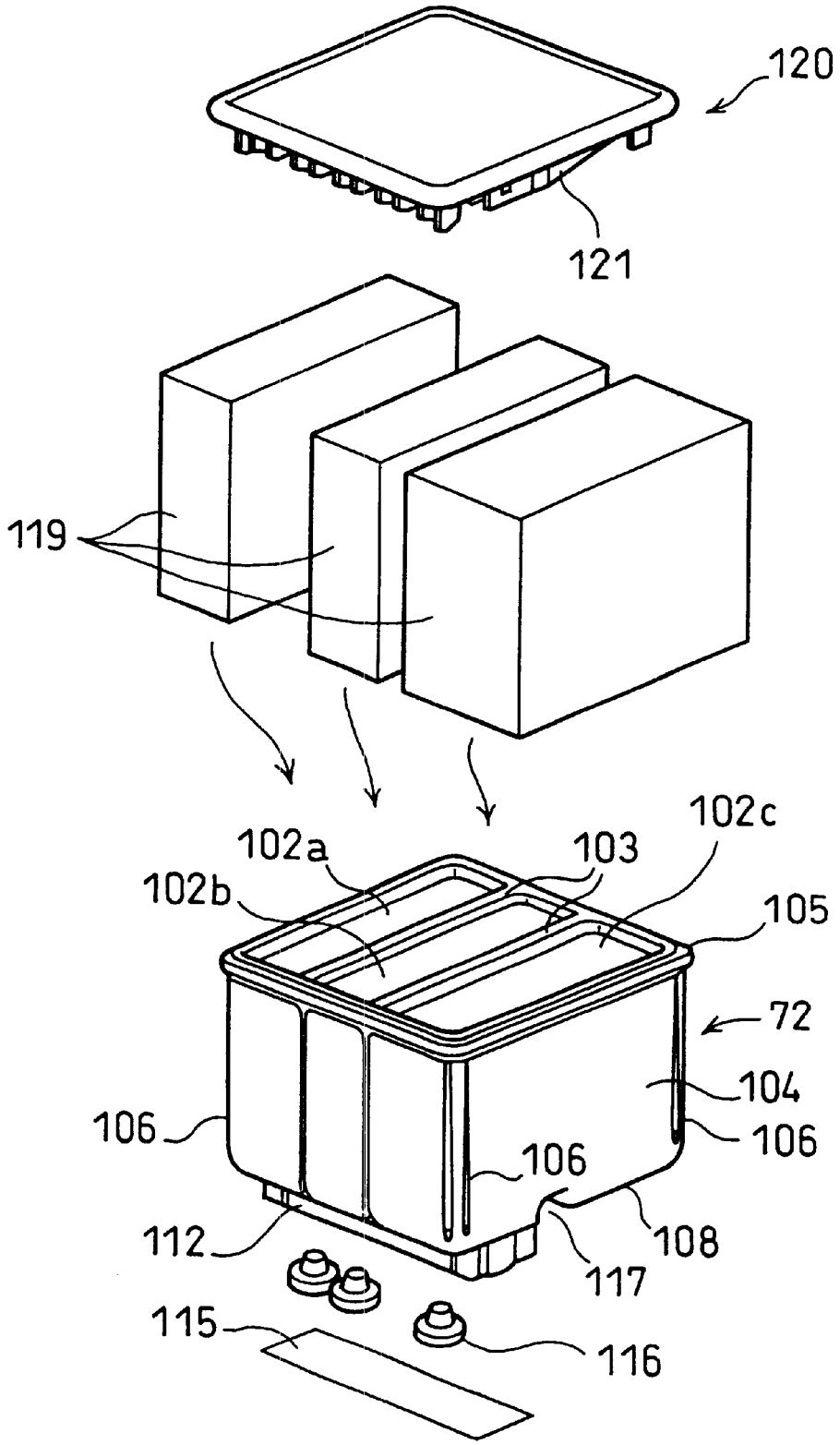
FIG. 7 is a decomposed perspective view showing the internal structure of the color ink cartridge 72.

FIG. 6 shows the appearance of the color ink cartridge 72 used in this embodiment, and FIG. 7 is a decomposed perspective view illustrating the ink cartridge 72. The black ink cartridge 71 has the same structure as that of the color ink cartridge 72, except that there is only one internal space for accommodating ink, so that only the structure of the color ink cartridge 72 is discussed here. The three different inks, magenta M, cyan C, and yellow Y, are accommodated in the color ink cartridge 72. The ink cartridge 72 is composed of polypropylene and has an outer shape of substantially rectangular parallelepiped without any surface fringes to enable as much quantity of ink as possible to be received in a limited space. Inside the ink cartridge 72 is parted into three ink chambers 102*a* through 102*c* via partition walls 103. The respective color inks of yellow, magenta, and cyan that are absorbed in foams 119 of porous sponge material are placed in the respective ink chambers 102*a* through 102*c*. In the illustration of FIG. 7, the foams 119 are drawn out of the respective ink chambers 102*a* through 102*c*. As clearly understood from the illustration, the foams 119 have greater volumes than those of the corresponding ink chambers 102*a* through 102*c*, so that the foams 119 are received in a compressed manner in the ink chambers 102*a* through 102*c*. The yellow ink Y is stored in the ink chamber 102*a*, the magenta ink M in the ink chamber 102*b*, and the cyan ink C in the ink chamber 102*c*. Among the three ink chambers 102*a* through 102*c*, the ink chamber 102*c* for the cyan ink has an inner volume of approximately 1.5 times as large as those of the other ink chambers 102*a* and 102*b*. Namely the quantity of cyan ink reserved is greater than those of magenta ink and yellow ink.

An outer wall 104 of the ink cartridge 72 has a greater wall thickness than that of the respective partition walls 103. An opening fringe 105 on the upper end of the ink cartridge 72 is extended outward to give an additional wall thickness. The opening fringe 105 ensures the sufficient rigidity of the ink cartridge 72. Ribs 106 are integrally formed and projected from the corners of the outer wall 104 for the purpose of positioning relative to the carriage 30 and maintaining the own shape.

Cylindrical ink supply openings (not shown) linked with one another are formed in a protruding manner on bottom faces 108 of the respective ink chambers 102*a* through 102*c*. The outer circumference of these ink supply openings is surrounded by a common strip-like frame 112. The ink supply openings are sealed with a sealing tape 115 in storage. Sealing rubbers 116 set in the respective ink supply openings to tightly join the ink supply openings with the ink supply conduits 76 when the ink cartridge 72 is attached to the carriage 30.

A fitting concave 117 is formed along the alignment of the ink supply openings on the bottom face 108 of the ink cartridge 72. The fitting concave 117 receives a support bar of a lifter (not shown) provided on the carriage 30. This prevents the ink cartridge 72 from being mistakenly attached to the carriage 30. The fitting concave 117 forms a step in the ink cartridge 72 and thereby exerts the following effects. A specific part of ink staying at a lower position than an exit of the ink cartridge 72, through which ink is flown out, can not be sucked out completely by means of capillarity of the foams 119. The presence of the step prevents the foams 119 absorbing ink therein from being located at the lower position than the exit of the ink cartridge 72. This structure effectively reduces the waste of ink. The step also ensures a space required for vacuum packing the whole ink cartridge 72 in an aluminum bag.

A cover member 120 is removably fitted in the upper opening of the ink cartridge 72 to close the opening. Vertical ribs 121 are protruded from the inner face of the cover member 120 to press the foams 119 received in the ink chambers 102*a* through 102*c*. Two arrays of the vertical ribs 121 are arranged at a predetermined interval corresponding to each of the ink chambers 102*a* through 102*c*. The vertical ribs 121 have a length that enables the cover member 120 to slightly slide along the longitudinal axis thereof. The vertical ribs 121 have greater protruding portions corresponding to the positions of the ink supply openings in the bottom face 108 of the ink cartridge 72. When the cover member 120 is fitted in the main body of the ink cartridge 72, the vertical ribs 121 press specific parts of the foams 119 corresponding to the positions of the ink supply openings more strongly than other parts, so that the pores in the specific parts of the foams 119 are contracted. This results in enhancing the action of capillarity on the side of the ink supply openings and causes ink homogeneously absorbed in the foam 119 to gather near the corresponding ink supply opening while the remaining quantity of the ink gradually decreases.

The following describes the compositions of the respective color inks, cyan, magenta, yellow, and black. As shown in FIG. 8, the cyan ink (C in the table of FIG. 8) has 3.6% by weight of the dye Direct blue 199, 30% by weight of diethylene glycol, 1% by weight of Surfinol 465, and 65.4% by weight of water. The magenta ink (M in the table of FIG. 8) has 2.8% by weight of the dye Acid red 289, 20% by weight of diethylene glycol, 1% by weight of Surfinol 465, and 76.2% by weight of water. The yellow ink (Y in the table of FIG. 8) has 1.8% by weight of the dye Direct yellow 86, 30% by weight of diethylene glycol, 1% by weight of Surfinol 465, and 67.2% by weight of water.

Figure 10:
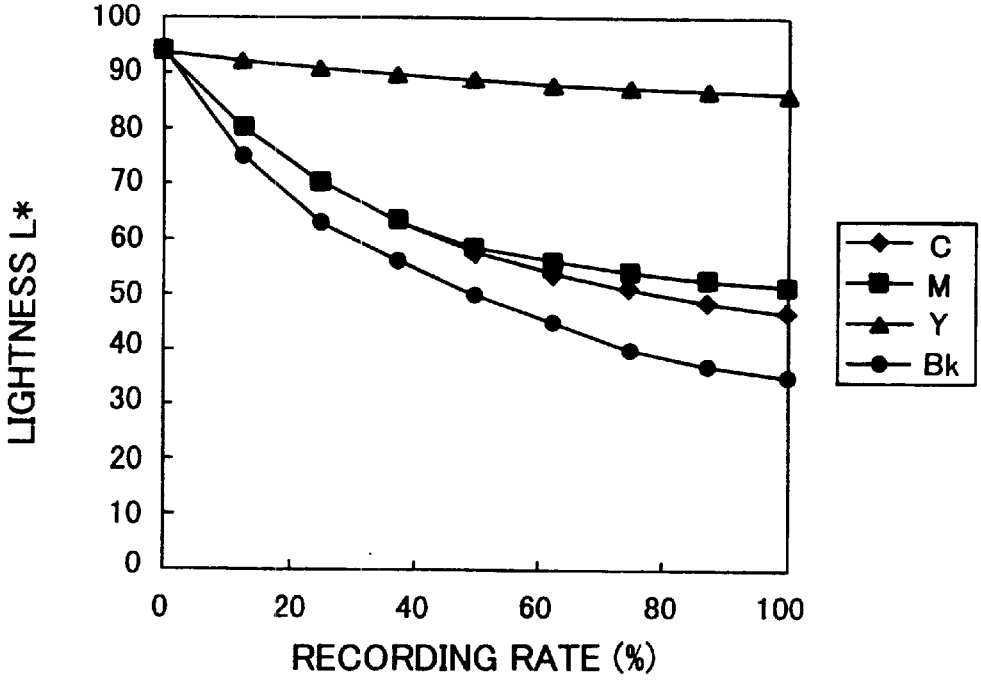
Fig. 10 PRIOR ART
FIG. 10 is a graph showing the lightness L* plotted against the dot recording rate of the respective color inks used in this embodiment.
Figure 11:
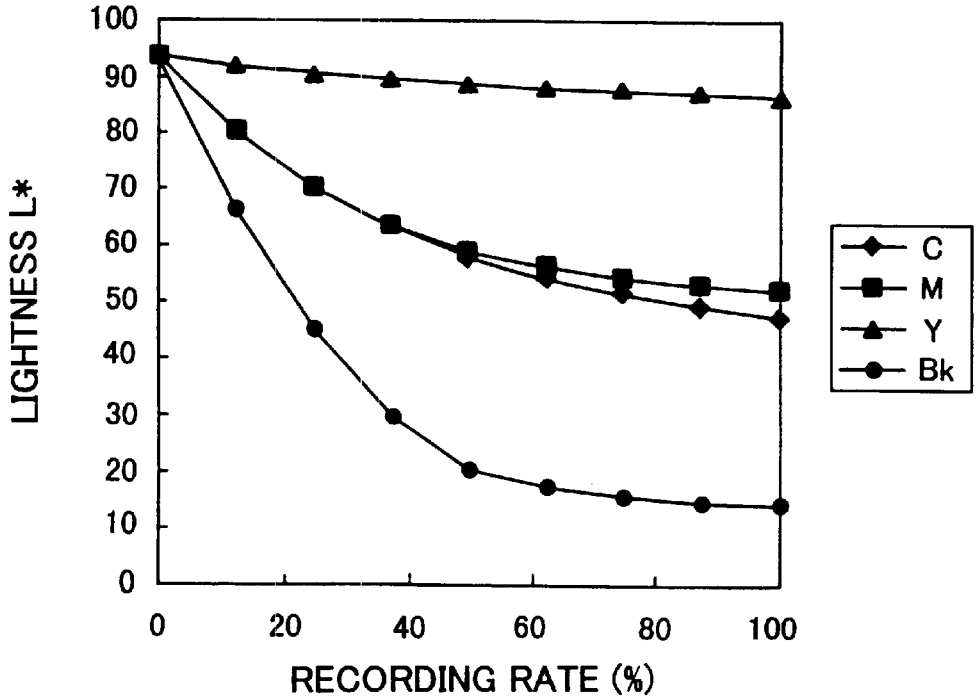
FIG. 11 is a graph showing the lightness L* plotted against the dot recording rate of the respective color inks used in the conventional printer.

The black ink (Bk in the table of FIG. 8) has 1.4% by weight of the magenta dye Acid red 289, 0.9% by weight of the yellow dye Direct yellow 86, 2.4% by weight of the black dye Food black 2, 25% by weight of diethylene glycol, 1% by weight of Surfinol 465, and 69.3% by weight of water. The black ink in this embodiment is accordingly not achromatic black ink but is mixing black ink and has a little reddish tone because of the addition of the magenta dye and yellow dye. For the purpose of comparison, the table of FIG. 9 shows the compositions of the respective color inks including the real black ink, which is achromatic ink containing only Food black 2 as the dye. The compositions of the other color inks in the table of FIG. 9 are identical with those in the table of FIG. 8. FIG. 10 is a graph showing the lightness L* plotted against the recording rate of the respective color inks in this embodiment (see FIG. 8), and FIG. 11 is a graph showing the lightness L* plotted against the recording rate of the conventional inks (see FIG. 9). The recording rate is expressed as a relative value representing a percentage of dots actually created to the case of 100[%], in which white paper is filled with dots of a particular color ink. The lightness L* refers to the brightness of a certain area printed at each recording rate, which is measured with a colorimeter. The comparison between the graphs of FIGS. 10 and 11 shows that the mixing black ink of this embodiment has a less content of the black dye Food black 2 and contains the magenta dye and the yellow dye, which have higher lightness than that of the black dye, thereby having substantially double the lightness of the real black ink at a fixed recording rate.

All the inks are adjusted to have a substantially identical viscosity (3.0 [mPas]) and surface tension, so that the same control procedure can be applied for controlling the piezoelectric elements PE on the respective ink ejection heads 61 through 64, regardless of the different inks.

Figure 12:
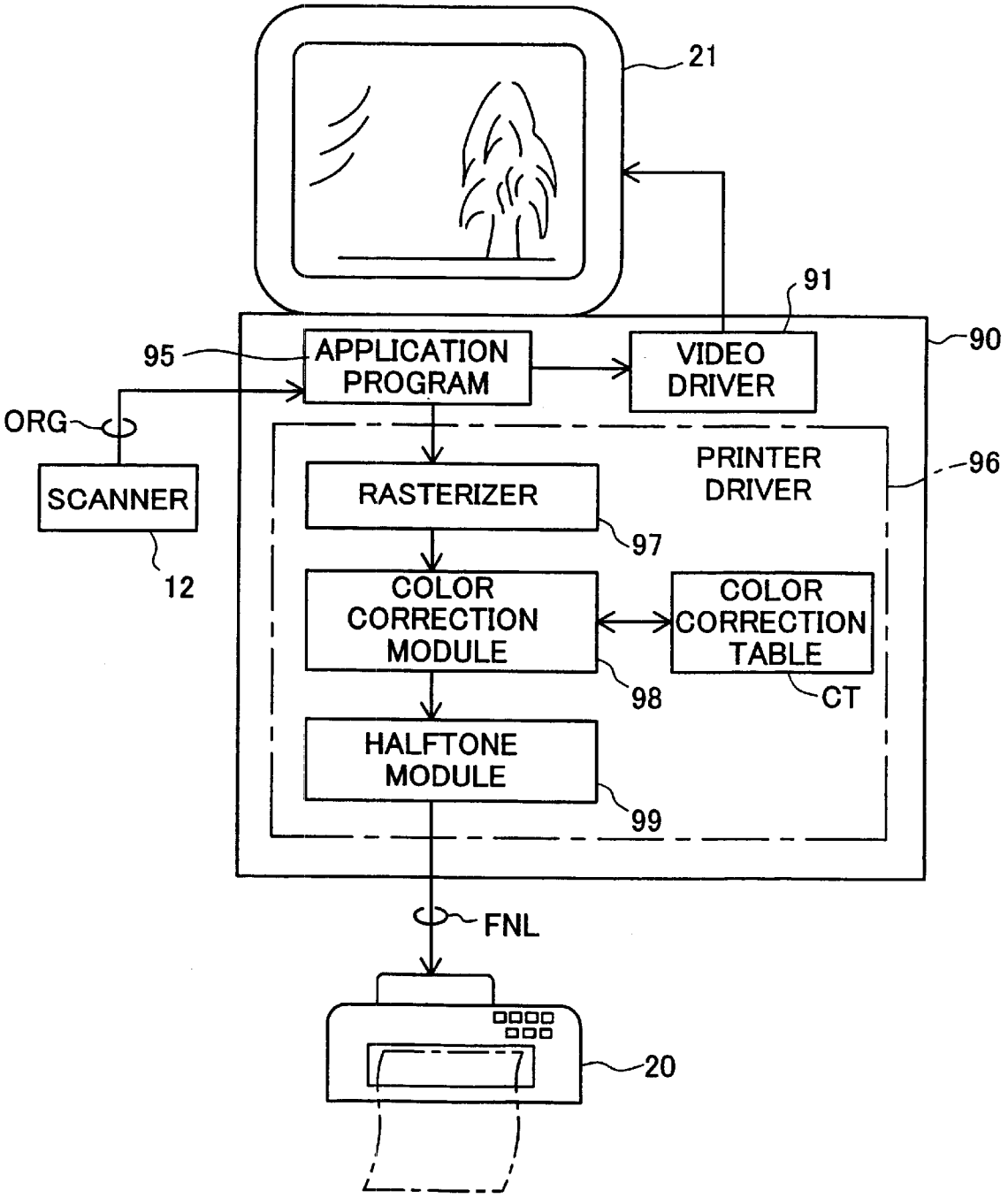
FIG. 12 is a block diagram showing a series of processes from inputting image information into a computer 90 to printing a resulting image by the printer 20.

The following describes a series of processes from inputting an original image to printing a resulting image by the printer 20, with reference to FIG. 12. The printer 20 records a multi-color image, based on the signals transmitted from the computer 90 or another image generating apparatus via the connector 56 (see FIG. 3). In the illustrated example of FIG. 12, an application program 95 working inside the computer 90 carries out required image processing and causes an image to be displayed on the CRT display 21 via a vide driver 91. In response to an issue of a printing instruction output from the application program 95, a printer driver 96 in the computer 90 receives image information from the application program 95 and converts the input image information into signals printable by the printer 20. In the example of FIG. 12, the printer driver 96 includes a rasterizer 97 that converts image information processed by the application program 95 into color information by the unit of the dot (tone data), a color correction module 98 that carries out color correction of the tone data (the image information converted into the color information by the unit of the dot) according to the color development properties of the employed image output apparatus (the printer 20 in this embodiment), and a halftone module 99 that generates halftone image information for expressing a density in a certain area by the presence or non-presence of ink by the unit of the dot, based on the color-corrected tone data. The operations of these modules are known in the art and thereby not specifically described herein.

It is generally impossible to regulate the density of ink in the printer 20. The tone of the image is accordingly expressed by regulating the density in a certain area by creation or non-creation of fine dots with ink. The input image data are eventually replaced by the dot recording rates. The image data input from the scanner 12 or the like are processed as 256-tone data for the three primary colors R (red), G (green), and B (blue) in the computer 90. The printer 20, however, processes the image data with regard to the three primary colors C (cyan), M (magenta), and Y (yellow) and black (Bk). The color correction module 98 carries out the color correction to convert the RGB image data into the CMYK image data. The rate of the black ink Bk is determined in the following manner.

The color mixing system applied for printing with ink is subtractive color mixing, so that mixture of cyan, magenta, and yellow is assumed to be equivalent to black as long as the densities of all the three primary colors, cyan, magenta, and yellow, are 100[%]. The black hue expressed by CMY is generally referred to as the composite black. Dots created with the real black ink cause enhanced granularity. In the case of high-quality printing, the black color is expressed by the composition black if possible. The composite black is an expression of the black hue using the three primary color inks CMY. To express the black color having the density of 100[%], for example, the total quantity of inks required for the composite black is almost three times the quantity of ink required for the real black. Some types of paper have the upper limit of the ink duty lower than 300[%]. In such cases, the restriction of the ink duty forces part of the primary color inks CMY to be replaced by the black ink.

Figure 13:
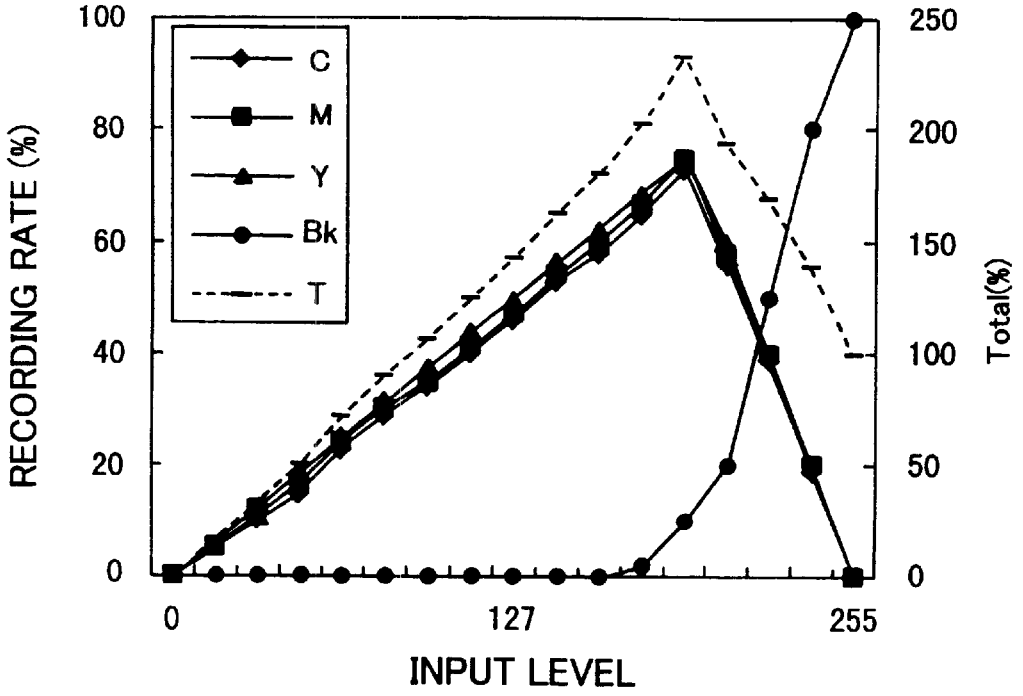
Fig. 13 PRIOR ART
FIG. 13 is a graph showing the dot recording rate plotted against the input level of image data with regard to the conventional inks.

FIG. 13 is a graph showing an exemplary dot recording rates of respective color inks to express an achromatic color, gray, in the case where the conventional inks are used to record a full-color image on standard paper. In the graph of FIG. 13, the right ordinate represents the recording rates of the respective color inks, cyan (C), magenta (M), yellow (Y), and black (Bk), and the right ordinate represents the total recording rate corresponding to a total quantity T of inks. In the example of FIG. 13, the paper used has the ink duty of approximately 250[%] as the recording rate. In order to prevent the total quantity T of inks from exceeding the ink duty of 250[%], the expression by the composite black (CMY) is replaced with the expression by the real black ink (Bk) after the input level of the image data exceeds about 160/255. The conventional technique starts creation of dots with the real black ink (Bk) when the input level exceeds about 160/255. The technique determines the rate of the real black ink (Bk) to maximize the total quantity T of inks around the input level of 190/255. After the input level exceeds about 190/255, the technique decreases the dot recording rates of the C, M, and Y inks by an identical value and correspondingly increases the dot recording rate of the real black ink (Bk). It is, of course, possible to use the greater quantities of the C, M, and Y inks without decreasing the total quantity T of inks in the range of the input level exceeding 190/255. In the area having the high density in the original image, however, a number of dots created with the real black ink do not significantly affect the picture quality of the resulting printed image. The technique determines the variation in rate of the real black ink by taking into account the restriction of the ink duty and the reduced total consumption of inks.

Figure 14:
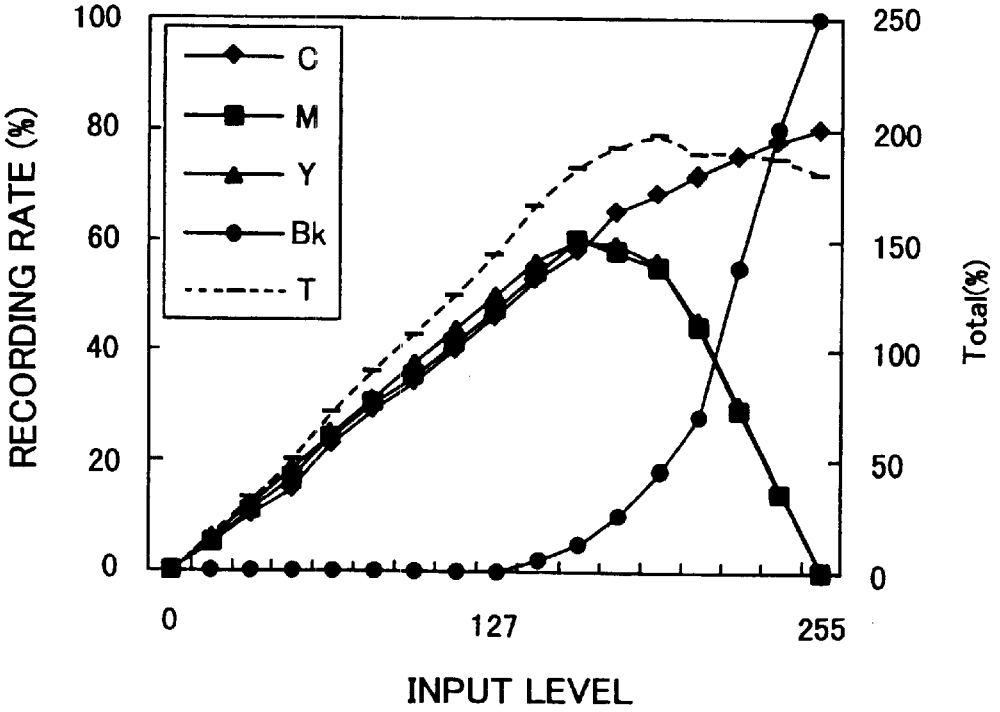
FIG. 14 is a graph showing the dot recording rate plotted against the input level of image data with regard to the inks of this embodiment.

In this embodiment, on the other hand, the mixing black ink (Bk) shown in FIGS. 8 and 10 has different hue and density from those of the conventional real black ink (Bk) shown in FIGS. 9 and 11. The dot recording rates of the respective color inks in the technique of this embodiment thereby have remarkably different behaviors from those of the respective color inks in the conventional technique. The graph of FIG. 14 shows the dot recording rates of the respective color inks plotted against the input level of the image data in this embodiment. As shown in FIG. 14, the technique of this embodiment starts creation of dots with the mixing black ink (Bk) when the input level exceeds about 127/255. When the input level is equal to 255/255, that is, represents expression of 100[%] black color, the conventional printer does not use any of cyan, magenta, and yellow inks but uses only the real black ink. (Bk) to create dots as shown in the graph of FIG. 13. The printer 20 of this embodiment, on the other hand, uses both the mixing black ink (Bk) and the cyan ink (C) to create dots. Namely the technique of this embodiment enables the expression of achromatic colors by the mixture of the mixing black ink (Bk) and the cyan ink (C), in addition to by the composite black and the real black ink (Bk).

The technique of this embodiment has the following advantages:

(1) The mixing black ink (Bk) has a lower fraction of the black dye and contains the magenta and yellow dyes. As described previously with reference to the graph of FIG. 10, the mixing black ink has higher lightness L*. This causes the dots created with the mixing black ink to have less granularity, compared with the dots created with the conventional real black ink (see FIG. 9). This technique accordingly enables creation of dots with the mixing black ink to start in the range of the lower input level of image data, while maintaining the high picture quality. Using the mixing black ink from the range of lower density ascertains clear images of high picture quality. Compared with the case where the achromatic color is expressed only by the composite black or with the case where the conventional real black ink is used to create dots, this technique gives the clearer images without causing an increase in granularity.

(2) Creation of dots with the mixing black ink reduces the quantities of the respective colors inks C, M, and Y for the composite black, and thus advantageously decreases the total quantity of inks. As shown in the graph of FIG. 14, the technique of this embodiment reduces the maximum total quantity T of inks, compared with the conventional technique shown in the graph of FIG. 13. This ensures printing even on the paper of low ink duty.

(3) The mixing black ink (Bk) is used in the wider range of the input level of image data. This gives a gentler slope of the recording rate against the input level. The gentler slope results in enriching the tone expression in the high density area and thereby improving the picture quality in the high density area of the resulting printed image.

(4) The color ink cartridge 72 used in this embodiment accommodates the cyan ink (C) of approximately 1.5 times as much volume as the magenta ink (M) or the yellow ink (Y) as shown in FIG. 6. Since the quantity of the cyan ink (C) used for printing continues increasing even in the high density area as shown in FIG. 14, the consumption of the cyan ink (C) is relatively increased. Such arrangement of volumes in the color ink cartridge 72 effectively prevents only the cyan ink from being used up while sufficient quantities of the magenta ink and the yellow ink still remain, which leads to replacement of the color ink cartridge 72 and wastes of the remaining magenta ink and yellow ink.

Figure 15:
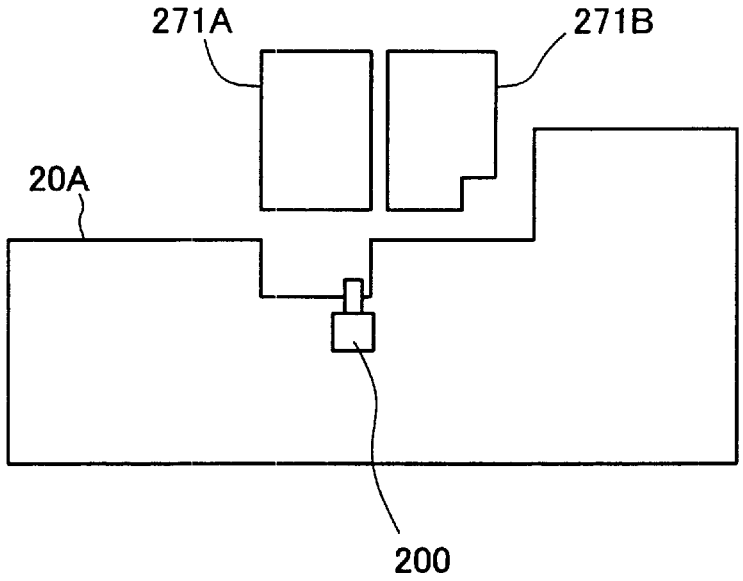
FIG. 15 shows a cartridge identification mechanism in one modified example.
Figure 16:
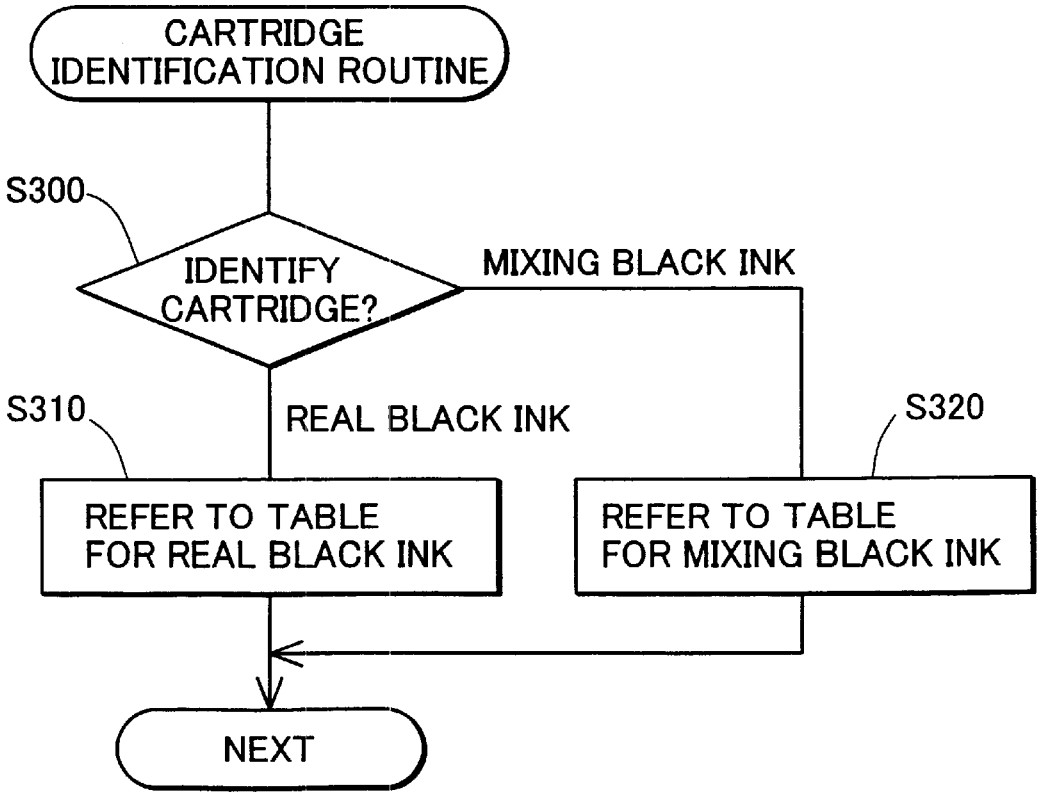
FIG. 16 is a flowchart showing a cartridge identification routine executed in the modified example.

(5) The technique of this embodiment, which uses the inventive black ink cartridge 71 in place of the conventional black ink cartridge, requires the different table (see FIG. 14) for determining the dot recording rates of the respective color inks against the input level of image data from the table conventionally used (see FIG. 13). It is thus not necessary to adjust the hardware configuration or replace any crucial parts, as long as the black ink cartridge 71 of this embodiment is designed to have the dimensions that are compatible with the conventional black ink cartridge used in the existing printer. This technique enables the existing printer to be effectively used with the inventive black ink cartridge 71. This also attains the improvement in picture quality by a very little modification. FIGS. 15 and 16 show one example of such modification. A printer 20A of this embodiment has a sensor 200 that detects a difference between two ink cartridges 271A and 271B attachable to the printer 20A as shown in FIG. 15. In the flowchart of FIG. 16, the printer 20A identifies the ink cartridge based on the result of detection of the sensor 200 at step S300, and automatically selects the table suitable for the identified ink cartridge at step S310 or step S320. This modified example requires only the replacement of the black ink cartridge and may use the conventional color ink cartridge, if the unbalanced remaining quantities of the respective color inks is neglected.

Figure 17:
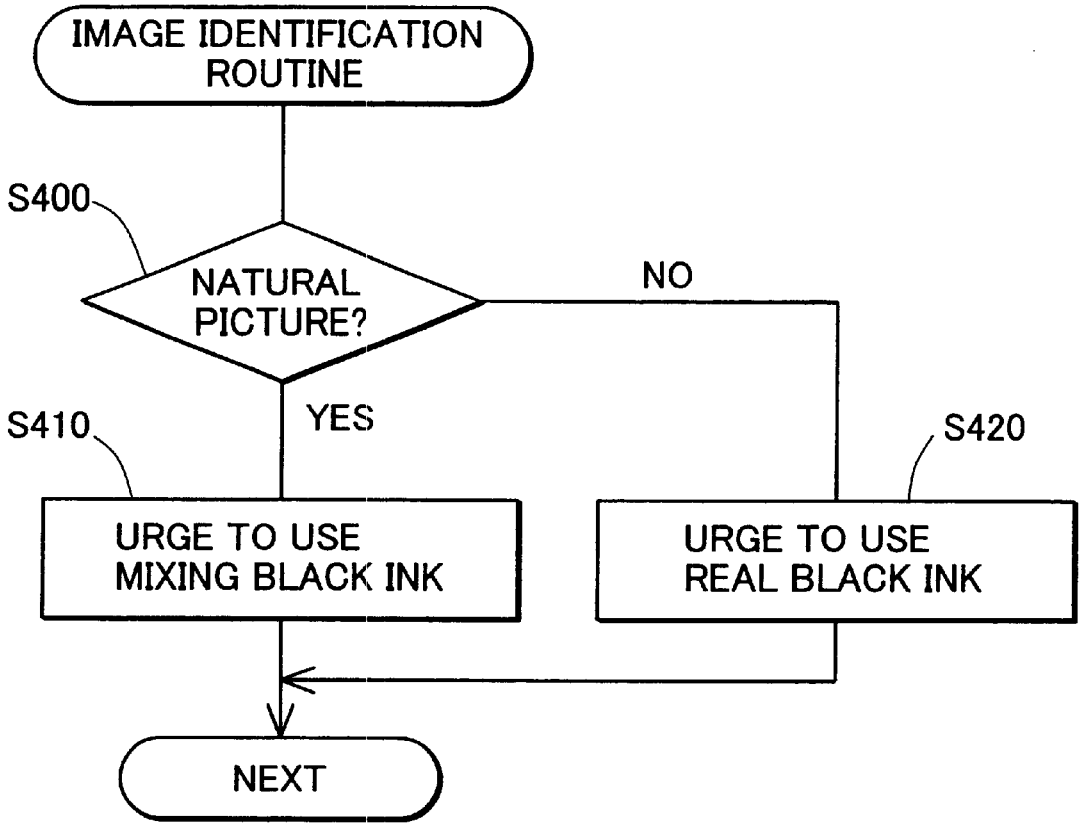
FIG. 17 is a flowchart showing an image identification routine executed in another modified example.

(6) The black ink cartridge 71 of this embodiment may be replaced with the conventional black ink cartridge according to the subject to be printed. The printer driver can determine whether the subject to be printed is a natural picture or letters. Referring to the flowchart of FIG. 17, in the case where the subject to be printed is a natural picture at step S400, the printer driver urges the user to use one black ink cartridge accommodating therein mixing black ink, which expresses the achromatic black color in cooperation with a specific chromatic color ink, like the black ink cartridge 71 of this embodiment, at step S410. In the case where the subject to be printed is letters at step S400, on the other hand, the printer driver urges the user to use the other black ink cartridge accommodating therein the conventional real black ink at step S420. One typical procedure may interrupt printing in the meantime of printing and output a message that urges the user to replace the ink cartridge. Another possible procedure may identify data included in the whole page to be printed and output a message that urges the user to use the black ink cartridge of this embodiment when the identified data include a natural picture, while urging the user to use the other black ink cartridge in which the conventional real black ink is reserved when the identified data do not include any natural picture. Another modification provides both the mixing black ink and the real black ink, which may be accommodated together in one ink cartridge or separately in different ink cartridges. The printer driver adequately selects one of the two black inks, depending upon whether the subject to be printed is a natural picture or letters. The black color included in graphs and images that require only several different hues may be expressed in the same manner as the black color of the letters.

The embodiment discussed above uses the cyan ink (C) as the specific chromatic color ink and the mixing black ink (Bk) containing the magenta and yellow dyes to express the black color. The combination of the inks is, however, not restricted to this embodiment, but there may be any combination that is capable of expressing the black color. By way of example, the specific chromatic color ink may be the yellow ink (Y), and the mixing black ink (Bk), which is capable of expressing the black color in combination with the yellow ink (Y), may contain the magenta and cyan dyes other than the black dye Food black 2. This example uses the yellow ink causing the least granularity for the specific chromatic color ink. In this case, it is accordingly not necessary to control creation of dots with the specific chromatic color ink in a very fine manner. In another example, both the cyan ink (C) and the magenta ink (M) may be used for the specific chromatic color inks, and the mixing black ink (Bk), which is capable of expressing the black color in combination with the cyan ink (C) and the magenta ink (M), may contain the yellow dye other than the black dye Food black 2. In this case, the mixing black ink (Bk) has the higher lightness than that of the above embodiment and thereby further reduces the degree of granularity. In any cases, the specific chromatic color ink used in combination with the mixing black ink (Bk) to express the black color has the greater volume accommodated in the ink cartridge.

Some known printers use light magenta ink and light cyan ink having the lower densities, as well as the standard magenta ink and cyan ink. The principle of the present invention is applicable to such printers using the lower density inks. The lower density inks are generally applied, in order to attain the high picture quality and more specifically to reduce the degree of granularity in low density areas. In this case, the total quantity of inks ejected on the paper tends to increase, so that the present invention is advantageously applied for such printers.

The above discussion does not specifically refer to the dot on-off control of the respective color inks according to the input level of image data. The known dither method or error diffusion method may be applied to determine the dot on-off conditions of the respective color inks.

The present invention is not restricted to the above embodiment or its modifications, but there may be many other modifications, changes, and alterations without departing from the scope or spirit of the main characteristics of the present invention. By way of example, the principle of the present invention is not restricted to ink jet printer using piezoelectric elements, but is also applicable to a different type of printer that has a heater placed in an ink conduit and ejects ink droplets by means of bubbles generated by the supply of electricity to the heater. The principle of the present invention is further applicable to thermal transfer printers, simplified printing machines, multi-tone copying machines, and facsimiles, as well as the ink jet printers.

The scope and spirit of the present invention are limited only by the terms of the appended claims.

What is claimed is:

1. A printer with a head that is capable of recording a plurality of different inks on a printing medium, wherein the plurality of different inks include a specific chromatic color ink having a predetermined hue and a particular ink having a certain hue, said printer comprising:

a black color recording unit configured to cause said head to record the specific chromatic color ink and the particular ink at a predetermined rate together on said printing medium so as to mix the specific chromatic color and the particular ink to express a black color, wherein the particular ink that is mixed with the specific chromatic color ink to express the black color includes a black colorant.

2. A printer in accordance with claim 1, wherein the specific chromatic color ink is either one of cyan ink and magenta ink.

3. A printer in accordance with claim 1, wherein the specific chromatic color ink causes low granularity when dots are created on said printing medium with the specific chromatic color ink.

4. A printer in accordance with claim 3, wherein the specific chromatic color ink causing the low granularity is yellow ink.

5. A printer in accordance with claim 1, said printer comprising:

an ink cartridge that accommodates therein, as the plurality of different inks, the specific chromatic color ink and the particular ink, as well as another color ink, which corresponds to one of three primary colors and is capable of expressing a predetermined color space in cooperation with the specific chromatic color ink having the predetermined hue;

an ink rate setting unit that sets a rate of quantities of the respective inks corresponding to a color to be expressed in the predetermined color space; and a head driving unit that drives said head to record the respective inks on said printing medium at the rate set by said ink rate setting unit, with regard to image data to be printed.

6. A printer in accordance with claim 5, wherein the respective inks are liquid, said head has a mechanism for causing each of the respective inks to be ejected in the form of ink droplets on said printing medium, and said ink rate setting unit stores a specific value that satisfies an ink duty of said printing medium, for the rate of the quantities of the respective inks.

7. An ink cartridge attached to a printer with a head that is capable of recording a plurality of different inks on a printing medium, wherein two among the plurality of different inks are a specific chromatic color ink having a predetermined hue and a particular ink having a certain hue that is mixed with the specific chromatic color ink at a predetermined rate to express a black color, at least one of the two inks is accomodated in said ink cartridge, and the particular ink that is mixed with the specific chromatic color ink to express the black color includes a black colorant.

8. An ink cartridge in accordance with claim 7, wherein the two inks are respectively reserved in different ink chambers that are parted in one identical casing of said ink cartridge.

9. An ink cartridge in accordance with claim 7, wherein the specific chromatic color ink is any one of cyan ink, magenta ink, and yellow ink.

10. An ink cartridge in accordance with claim 7, said ink cartridge accommodating another color ink that corresponds to one of three primary colors and is capable of expressing a predetermined color space in cooperation with the specific chromatic color ink having the predetermined hue, in addition to the specific chromatic color ink.

11. An ink cartridge in accordance with claim 10, wherein a volume of the specific chromatic color ink accommodated in said ink cartridge is preset to be greater than a volume of the another color ink by a predetermined factor.

12. A method of causing a printer to print an image with a head that is capable of recording a plurality of different inks on a printing medium, said method comprising the steps of:

providing a specific chromatic color ink having a predetermined hue and a particular ink having a certain hue that is mixed with a specific chromatic color ink at a predetermined rate to express a black color, as two among the plurality of different inks; and causing said head to record the two inks at the predetermined rate on said printing medium, so as to express the black color, wherein the particular ink that is mixed with the specific chromatic color ink to express the black color includes a black colorant.

13. A program product comprising a program code, which causes a printer to print an image with a head that is capable of recording a plurality of different inks on a printing medium, and a recording medium in which said program code is stored in a computer readable manner, wherein said program code comprises:

a first program code that causes a computer to input a density of black color included in an image to be recorded;

a table that stores recording rates of a specific chromatic color ink and a mixing black ink including a black colorant, which are included in the plurality of different inks, corresponding to a varying density of black color, the specific chromatic color ink having a predetermined hue, the mixing black ink having a certain hue that is mixed with the specific chromatic color ink at a predetermined rate to express a black color; and a second program code that causes the computer to refer to said table and determine the recording rates to the specific chromatic color ink and the mixing black ink corresponding to the input density of black color.

14. A program product in accordance with claim 13, wherein said program code further comprises:

a third program code that causes the computer to identify an ink cartridge attached to said printer and determine which of an ink cartridge accommodating therein the mixing black ink and another ink cartridge accommodating therein a real black ink that is capable of expressing a black color independently;

a fourth program code that causes the computer to select an appropriate table for the identified ink cartridge among a plurality of tables, which are provided for different ink cartridges and store recording rates of respective inks corresponding to a varying density of black color; and a fifth program code that causes the computer to refer to the selected table and determine the recording rates of the respective inks.

15. A program product in accordance with claim 13, wherein said program code further comprises;

a sixth program code that causes the computer to identify an image to be recorded;

a seventh program code that causes the computer to record an image with an ink cartridge accommodating therein the mixing black ink in the case where the identified image is a natural picture; and an eighth program code that causes the computer to record an image with another ink cartridge accommodating therein a real black ink that is capable of expressing a black color independently, in the case where the identified image is not a natural picture.

16. A product comprising data, which are referred to by a program for controlling a printer that prints an imge with a head that is capable of recording a plurality of different inks on a printing medium, and a recording medium, in which said data are recorded in a computer readable manner, wherein said data comprise a table that stores recording rates of a specific chromatic color ink and a mixing black ink including a black colorant, which are included in the plurality of different inks, corresponding to a varying density of black color included in an image to be recorded, the specific chromatic color ink having a predetermined hue, the mixing black ink having a certain hue that is mixed with the specific chromatic color ink at a predetermined rate to express a black color.

17. An ink cartridge attached to a printer with a head that is capable of recording a plurality of different inks on a printing medium, wherein two among the plurality of different inks are mixed to express a black color, one of the two inks is a mixture of a black color ink and a specific chromatic color ink having a predetermined hue, and the other ink has another hue included in the three primary colors, relative to said specific chromatic color, at least one of the two inks is accomodated in said ink cartridge, and a particular ink that is mixed with the specific chromatic color ink to express the black color includes a black colorant.

* * * * *